US005382005A

United States Patent [19]

Weiss

[11] Patent Number: 5,382,005

[45] Date of Patent: Jan. 17, 1995

[54] METHODS AND APPARATUS FOR FIRING EXTRUDED METALS

[75] Inventor: David S. Weiss, Corning, N.Y.

[73] Assignee: Corning Incorporated, Corning, N.Y.

[21] Appl. No.: 60,263

[22] Filed: May 12, 1993

Related U.S. Application Data

[62] Division of Ser. No. 734,147, Jul. 22, 1991, Pat. No. 5,225,155.

[51] Int. Cl.[6] ..... C21D 1/48

[52] U.S. Cl. ..... 266/257; 266/252

[58] Field of Search ..... 266/252, 249, 257, 200

[56] References Cited

U.S. PATENT DOCUMENTS

| | | | |
|---|---|---|---|
| 3,708,285 | 1/1973 | Scheyer | 419/2 |
| 4,996,022 | 2/1991 | Shindo et al. | 419/2 |
| 5,186,764 | 2/1993 | Stiasny | 266/252 |

FOREIGN PATENT DOCUMENTS

| | | |
|---|---|---|
| 351056 | 6/1989 | European Pat. Off. . |
| 404159 | 12/1990 | European Pat. Off. . |
| 732182 | 6/1955 | United Kingdom . |

*Primary Examiner*—Scott Kastler

*Attorney, Agent, or Firm*—Maurice M. Klee; Richard N. Wardell

[57] ABSTRACT

Methods and apparatus for protecting extruded metal powder green bodies (34) during firing are provided. In certain embodiments, one or more green bodies (34) are housed in a non-gas tight chamber (13) located in the hot zone (24) of a cold-wall vacuum/atmosphere furnace (10). Furnace gas, e.g., hydrogen, is supplied to the interior of the chamber (13). The resulting one-way flow out of the chamber (13) protects the green bodies (34) from the backflow of burn-out products, as well as from contaminants arising from the walls and internal components of the furnace (10). In other embodiments, green bodies (34) are housed in individual non-gas tight containers (36). The containers (36) minimize the amount of furnace gas which comes into contact with the green bodies (34) during sintering and thus minimize the level of exposure of the green bodies (34) to oxidative impurities in the furnace gas. When composed of the same material as the green bodies, the containers (36) also perform a getter function.

7 Claims, 3 Drawing Sheets

20 μm

20 μm

METHODS AND APPARATUS FOR FIRING EXTRUDED METALS

CROSS REFERENCE TO RELATED APPLICATION

This application is a division of copending application Ser. No. 07/734,147, filed Jul. 22, 1991. Now U.S. Pat. No. 5,225,155.

BACKGROUND OF THE INVENTION

1. Field of the Invention

This invention relates to methods and apparatus for firing extruded metal structure. In particular, the invention relates to the firing of metal honeycombs (monoliths) for use as catalyst supports in vehicle exhaust systems.

2. Description of the Prior Art

As known in the art, the basic steps for creating an extruded metal structure comprise: 1) forming a mixture of one or more metal powders, an organic binder, and, as required, one or more additives, 2) extruding the mixture to form a green body, 3) drying the green body, 4) burning the binder out of the green body, and 5) sintering (densifying) the green body at temperatures above about 1150° C. to produce the desired structure. See, for example, European Patent Publication No. 351,056 and U.S. Pat. Nos. 4,758,272 and 4,871,621, the relevant portions of which are incorporated herein by reference.

The present invention relates to steps (4) and (5), i.e., burn-out and sintering, which collectively will be referred to herein as "firing" of the green body. More particularly, the invention relates to methods and apparatus for controlling the environment around the green body during firing so as to 1) improve the sintering process, 2) reduce the level of contamination introduced into the metal structure during firing, and 3) improve the physical and chemical properties of the finished product.

As discussed in detail below, in accordance with the invention, it has been found that during the firing process, the metal powders of the green body are highly sensitive to even minute levels of contaminants, in particular, oxidative contaminants, which can react with the hot, and thus strongly reactive, powder. Such contaminants can arise from various sources including the furnace used for the firing, the gas or gases supplied to the furnace during firing (the "furnace gas" or the "processing gas"), or from the products produced upon burn-out of the binder (the "burn-out products"). The importance of protecting the green body from even minute levels of contaminants arising from such sources has not previously been recognized in the art. Similarly, the methods and apparatus discussed below which achieve the necessary levels of protection of the green body during firing have not been previously used in the art.

Various techniques for firing extruded metal structures have been disclosed in the art. For example, U.S. Pat. No. 2,902,363 discloses sintering a green body, composed of a mixture of a metal powder and an organic elastomer, in an atmosphere of hydrogen. See also U.S. Pat. No. 3,444,925 (argon or hydrogen) and U.S. Pat. No. 4,871,621 (argon or mixtures of nitrogen and hydrogen). Similarly, U.S. Pat. No. 2,709,651 discloses flowing a non-oxidizing gas such as hydrogen past a green body during firing. The flowing of the gas is said to aid in controlling the shrinkage of the green body as it is sintered. See also U.S. Pat. No. 4,758,272 (flowing argon) and EPO Patent Publication No. 351,056 (flowing hydrogen or a mixture of hydrogen and argon followed by flowing argon, hydrogen, or a mixture of hydrogen and argon).

Chemical means for improving the firing process have also been disclosed. In particular, U.S. Pat. No. 4,758,272 discloses including calcium or magnesium in the furnace to act as a getter for oxygen during firing. EPO Patent Publication No. 351,056 states that in place of calcium or magnesium, oxygen control can be achieved by burying the structure to be fired in fine or coarse alumina powder, by placing the structure on a zirconia plate, by burying the structure in zirconia beads, or by suspending the structure in a tapered alumina crucible.

Apparatus to aid in the drying of honeycomb structures is also known. Specifically, U.S. Pat. No. 4,439,929 discloses the use of a perforated support to hold ceramic green bodies during drying, while U.S. Pat. No. 4,837,943 discloses the perforated support in combination with a perforated cover (also referred to in the art as a "cookie").

Although these references address various aspects of the process of transforming extruded metals into rigid structures, none of them recognize or address the problem of protecting green bodies from minute levels of contaminants during firing.

SUMMARY OF THE INVENTION

In view of the foregoing state of the art, it is an object of the present invention to provide improved methods and apparatus for firing extruded metal structures. More particularly, it is an object of the invention to provide methods and apparatus for protecting extruded green bodies from contaminants, including oxidative contaminants, during the firing process. More specifically, it is an object of the invention to protect green bodies from contamination from binder burn-out products and impurities in the processing gas, as well as from contaminants originating from the firing furnace, e.g., from the furnace's cold wall and internal insulation (shield pack) in the case of a conventional cold-wall vacuum/atmosphere furnace.

In general terms, the foregoing as well as other objects are achieved by 1) controlling the flow patterns of burn-out products, furnace contaminants, and processing gas during firing, and 2) limiting the amount of processing gas which comes into contact with the green body during firing.

In accordance with certain aspects of the invention, flow pattern control is achieved by placing the green body in a non-gas tight chamber within the furnace and by supplying processing gas directly to this chamber. Preferably, the chamber is made of a refractory metal such as molybdenum. As discussed in detail below, the use of such a chamber has been found to protect the green body from furnace contaminants and to result in fired samples having improved uniformity in comparison to samples fired without the use of a chamber.

In accordance with other aspects of the invention, further flow pattern control for cold-wall vacuum/atmosphere furnaces is achieved by introducing furnace gas into both the chamber and into the cold zone portion of the furnace surrounding the shield pack, and by removing furnace gas from the hot zone portion of the furnace (see FIG. 2). This approach further prevents gas flow into the sample chamber from other furnace areas, thereby further reducing the opportunity for contamination of samples by furnace deposits.

In accordance with further aspects of the invention, the green bodies are housed in non-gas tight containers (canisters) sized to hold an individual green body. The containers limit the amount of furnace gas which comes into contact with the green body.

Specifically, as discussed in detail below, furnace gas enters the individual containers during burn-out, but essentially stops flowing into the containers at the end of burn-out and remains essentially stopped throughout sintering. As a result, the amount of furnace gas, and thus the amount of furnace gas impurities, which comes into contact with the green body during firing, and, in particular, during sintering, the most critical part of the firing process in terms of contamination, is limited. In practice, the use of individual containers has been found to result in fired products having porosity levels on the order of 5–10% in comparison to the 20–30% levels achieved without containers.

The containers can be made of a refractory metal or can themselves be composed of an extruded metal powder which is either in its green state or has been sintered, e.g., the containers can have the same composition as the green body. When unsintered material is used, the container not only shields the green body from furnace gas, but also serves as a getter for contaminants.

The accompanying drawings, which are incorporated in and constitute part of the specification, illustrate the preferred embodiments of the invention, and together with the description, serve to explain the principles of the invention. It is to be understood, of course, that both the drawings and the description are explanatory only are not restrictive of the invention.

DESCRIPTION OF THE PREFERRED EMBODIMENTS

As discussed above, the present invention is concerned with the firing of green bodies to produce extruded metal structures such as metal honeycombs for use as catalyst supports in vehicle exhaust systems.

The green body comprises an extruded mixture of a metal powder, a binder, and optionally other ingredients such as processing additives known in the art. Various metal powders, binders, and additives can be used in the practice of the invention. For example, in the case of honeycombs for catalytic converters, the metal powder can be made of iron and aluminum, the binder can be methylcellulose, and the additives can include oleic acid as a wetting agent and zinc stearate as a lubricant. Since the green body is formed by extrusion, the binder should comprise at least about 2 percent by weight of the mixture and preferably at least about 4 weight percent.

Figure 1:
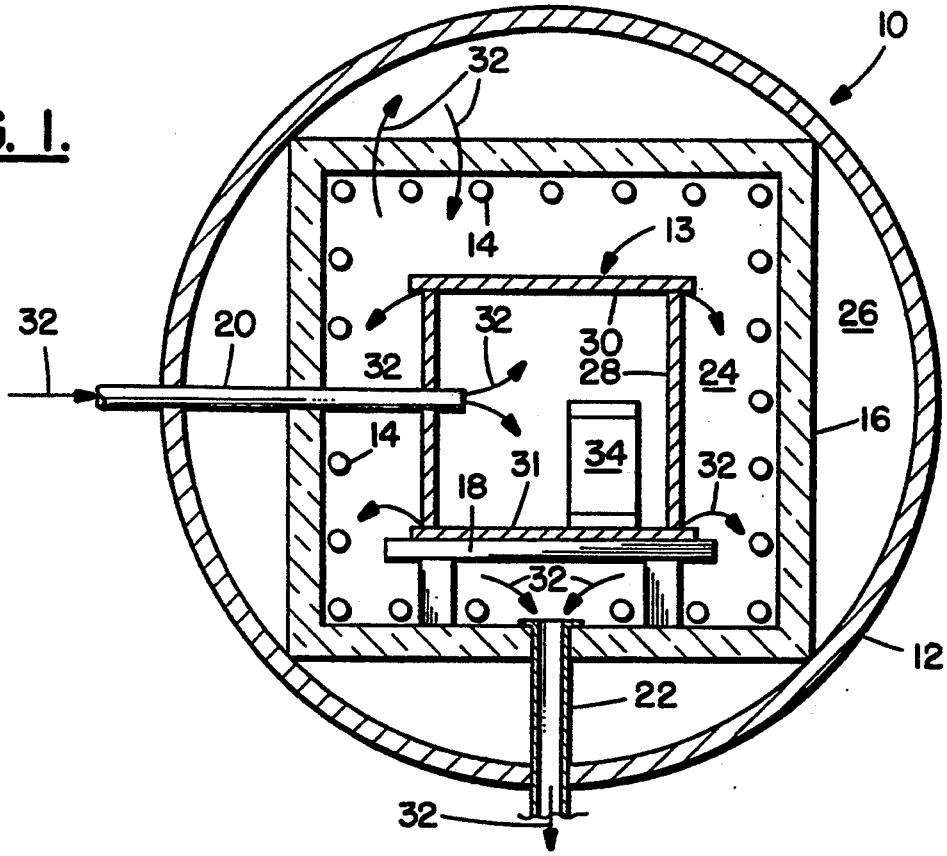
FIG. 1 is a schematic diagram of a cold-wall vacuum-/atmosphere furnace equipped with a non-gas tight chamber in accordance with the invention and employing a single gas inlet connected to the interior of the chamber.

With reference now to the figures, wherein like reference characters designate like or corresponding parts throughout the several views, there is shown in FIG. 1 a schematic of a cold-wall vacuum/atmosphere furnace 10 employing a non-gas tight chamber 13 constructed in accordance with the present invention. In FIG. 1 and the following figures, gas flows are shown by arrows 32.

Furnace 10 includes gas-tight cold wall 12, heating elements 14, porous heat shield (insulation) 16, hearth plate 18, gas inlet 20, and gas exit 22. The heating elements and heat shield define a hot zone 24 and a cold zone 26, which surrounds the hot zone.

As shown in FIG. 1, chamber 13 includes side walls 28, removable top wall 30, and bottom wall 31. These walls are preferably made of a refractory metal such as molybdenum. The chamber is non-gas tight so that furnace gas can move from the inside to the outside of the chamber. The non-gas tight state can be achieved by including spaces at the junctions between walls so that the gas can weep out of the chamber, or by incorporating specific exit ports in the side, top, and/or bottom walls.

Chamber 13 is located in hot zone 24 and carries in its interior one or more green bodies 34 which are to be fired. Generally, the chamber will have a volume in the range of from about 30% to about 60% of the overall volume of the hot zone. In order to reduce the amount of furnace gas needed to remove burn-out products from the green body, the chamber's internal volume should be kept as small as practically possible. For example, a chamber having a height, length, and width on the order of 6, 6, and 15 inches, respectively, has been found suitable for firing up to 4 honeycomb green bodies, each having a diameter of 3 inches and a height of 5 inches.

Furnace gas, e.g., hydrogen, is introduced into chamber 13 by means of gas inlet 20. During the burn-out phase, the gas picks up burn-out products given off by the green body and carries those products out of the chamber and to gas exit 22. As shown in FIG. 1, the gas exit is connected directly to hot zone 24. Alternatively, the gas exit could be connected to cold zone 26.

As shown in FIG. 1, gas flows 32 are directed outward from chamber 13. In this way, the green body is protected from exposure to backflow of binder burn-out products that linger in the furnace atmosphere and/or materials which volatilize from heat shield 16 and/or cold wall 12 at elevated temperatures. Materials that can volatilize include binder burn-out products from previous runs and/or furnace construction materials, e.g., ceramic insulation. Exposure to such contaminants results in fired parts which are typically discolored, have high carbon levels, and decreased oxidation resistance, all of which are undesirable. In addition to dealing with these problems, chamber 13 also serves as a heat shield to protect green bodies from heat radiating directly from heating elements 14, e.g., in cases where the elements are close enough to the green bodies to set up significant thermal gradients.

In practice, the use of chamber 13 has been found to improve the quality of the fired product for a variety of furnace constructions and green body compositions. In addition, furnace load uniformity has been found to be improved over firing with no protective chamber.

Figure 2:
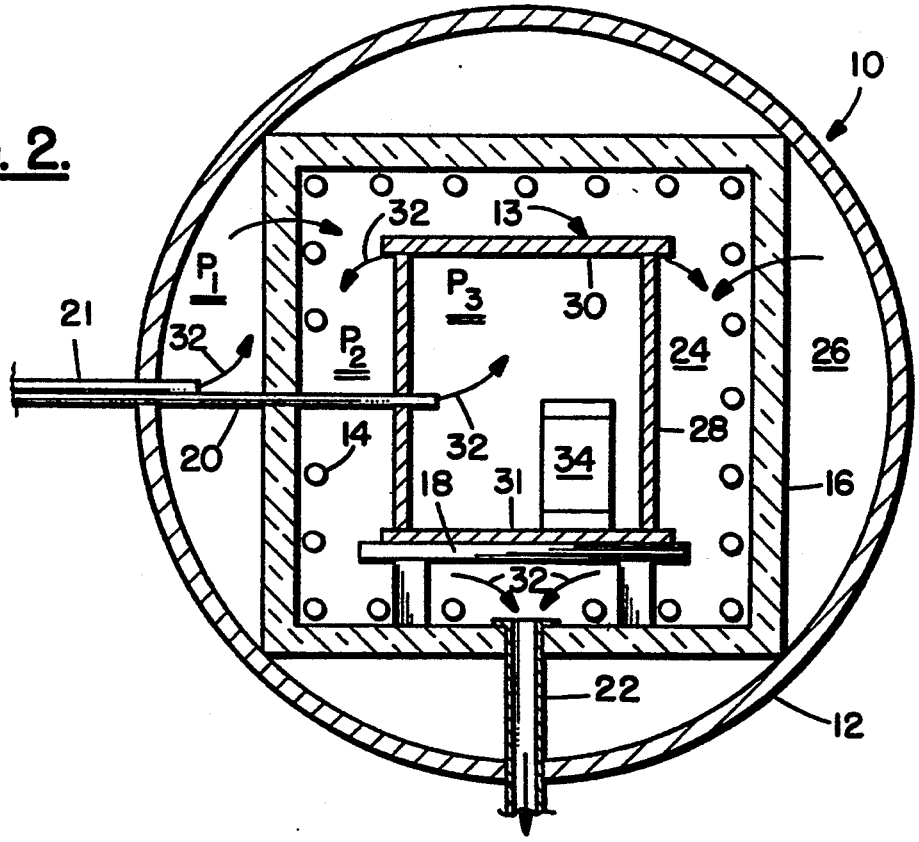
FIG. 2 shows the same apparatus as FIG. 1 but with two gas inlets, one connected to the interior of the chamber and the other connected to the furnace's cold zone.

Further control of furnace gas flows can be achieved by using chamber 13 in combination with the gas inlet/-outlet arrangement shown in FIG. 2. Specifically, gas inlet 20 is connected to the interior of chamber 13, gas inlet 21 is connected to cold zone 26, and gas outlet 22 is connected to hot zone 24. Each of the inlets has a separate flow controller (not shown) so that the pressures in the cold zone ($P_1$), the hot zone ($P_2$), and the chamber ($P_3$) can be adjusted so that $P_1$ is approximately equal to $P_3$, and both $P_1$ and $P_3$ are greater than $P_2$.

In this way, furnace gas is directed from the cold-wall section of the furnace into the hot-zone and then out through the exit, and from chamber 13 in which the green bodies are located into the hot zone and out. This arrangement prevents gas flow from any other furnace area into chamber 13, thereby further reducing the opportunity for contamination by furnace deposits. The arrangement also minimizes the level of deposit build-up in the furnace since burn-out products do not travel into the cold zone, but rather are immediately directed out of the furnace through gas exit 22.

Figure 3:
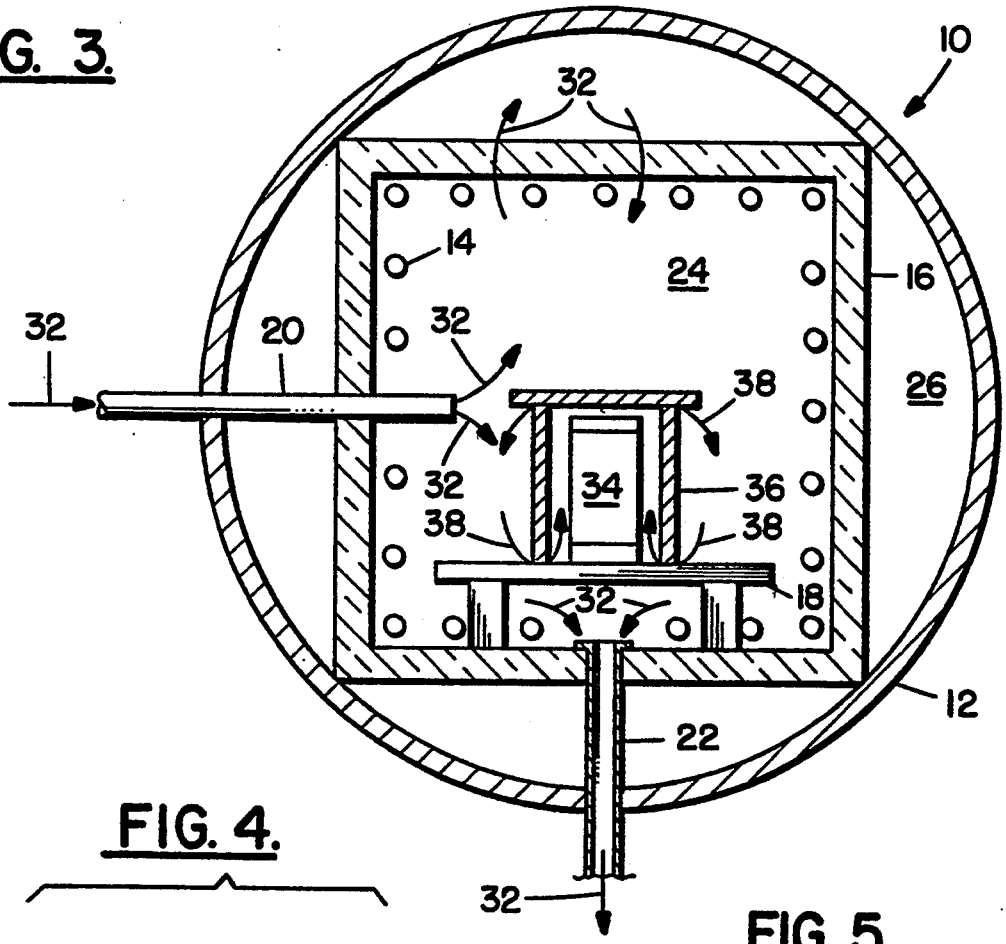
FIG. 3 is a schematic diagram of a cold-wall vacuum-/atmosphere furnace showing the gas flows during burn-out of a green body housed in a protective container sized to hold an individual green body.

FIG. 3 illustrates a further aspect of the invention, namely, the housing of green bodies in individual containers 36 during firing. Furnace 10 has the same basic construction as in FIGS. 1 and 2. As shown, gas exit 22 is connected to hot zone 24. Alternatively, the gas exit could be connected to cold zone 26. Similarly, gas inlet 20 is connected directly to hot zone 24. Alternatively, the gas inlet could be connected to the interior of a non-gas tight chamber 13, as in FIG. 1. Also, two gas inlets could be used as in FIG. 2.

Individual containers 36 perform the important function of minimizing the oxidation of the highly reactive metal powder in the green body by contaminants in the furnace gas during sintering. Such oxidation leads to high porosity, discoloration, distortion, and poor oxidation resistance in the fired product.

The individual containers also act as barriers to the radiant heat produced by heating elements 14. This barrier effect causes the green body to be exposed to a more uniform heat distribution, which in turn results in more uniform shrinkage during sintering.

Through the use of individual containers which enclose and buffer green bodies from the effects of contaminated gases and radiant heat, improvements in the following areas have been achieved: 1) overall uniformity of coloration, 2) lack of localized darkened spots, 3) more uniform oxidation resistance, and 4) less firing-related distortion.

In accordance with the invention, it has been determined that less than a 0.02% weight gain of oxygen during sintering can double porosity under otherwise identical firing conditions. Sufficient oxidants can be found as impurities in the furnace gas to cause this level of oxidation poisoning. For example, a suitable furnace gas is AIRCO "Grade-5" hydrogen (99.999% pure hydrogen). This gas is specified by the manufacturer to have no more than 1 ppm $O_2$, 1 ppm $H_20$, and 1 ppm CO and $CO_2$. However, since a typical gas flow rate during firing is 100 SCFH, even these low levels of contaminants are sufficient to produce significant oxidation of the metal powder in green bodies.

Containers 36 address this problem by reducing the amount of furnace gas that can interact with a green body during sintering, while at the same time allowing binder burn-out products to escape from the green body and be carried away in the flowing furnace gas. More particularly, as the binder products volatilize and leave the green body, they tend to flow upwards and exit through the top of the container, e.g., through leak spaces between the top and the walls of the container or, in the case of a honeycomb top, through the pores of the honeycomb (see below).

As the binder products leave the top of the container, furnace gas flows in through the bottom (again, through leak spaces around the bottom of the container or through honeycomb pores in the case of a honeycomb bottom). This flushing of the container continues until the volatiles are removed, which occurs by about 500° C. The flushing pattern is illustrated in FIG. 3 by flow arrows 38.

Once equilibrium is reached between the gas pressure in the container and that in the furnace, the atmosphere inside the container becomes quiescent. From this point on, the green body is no longer exposed to a flow of fresh furnace gas with oxidizing impurities. As a result, green bodies have been found to sinter more effectively than they do without individual containers. Specifically, through the use of such containers, porosity levels have been reduced from 20–30% to 0.5–10%.

The effectiveness of containers 36 is dependent upon the ratio of the container's internal volume to the green body's volume/mass. Specifically, a container that is close in dimensions to the enclosed green body works better than a container that has a lot of extra space inside. As a general rule of thumb, the green body should occupy at least about 40 percent of the internal volume of the container. In the case of Fe—Al honeycombs for use as catalyst supports, it has been found that sizing the container so that the green body occupies about 90% of the container's internal volume prior to firing works successfully. The volume ratio which works best for a particular application will depend upon the geometry and composition of the green body.

In addition to the green body/container volume ratio, the container's shape also plays a role in its effectiveness in protecting the green body. Specifically, the container's perimeter should be minimized since it is around the container's bottom perimeter, i.e., where the container sits on the furnace floor or hearth plate, that furnace gases generally enter the container during sintering. Preferably, the ratio of the container's perimeter to its internal volume should be kept less than about 0.5 inches$^{-2}$.

This ratio may not be achievable in all cases since ultimately, the shape of the container is dictated by the shape of the green body. To the extent possible, it is advantageous to adjust the shape of the green body so that it has a relatively small perimeter. For example, Table 1 gives circumference/volume ratios for a series of cylinders having a constant volume. As shown in this table, a circumference/volume ratio less than 0.5 inches$^{-2}$ can be obtained through a judicious choice of the cylinder's diameter and height. Accordingly, in designing a green body which is to be fired in a cylindrical container, it is desirable to select a shape for the green body which will fit into a container whose circumference/volume ratio is small. Similar design considerations apply to containers having other shapes, and tables like Table 1 can be prepared for such containers.

Figure 4:
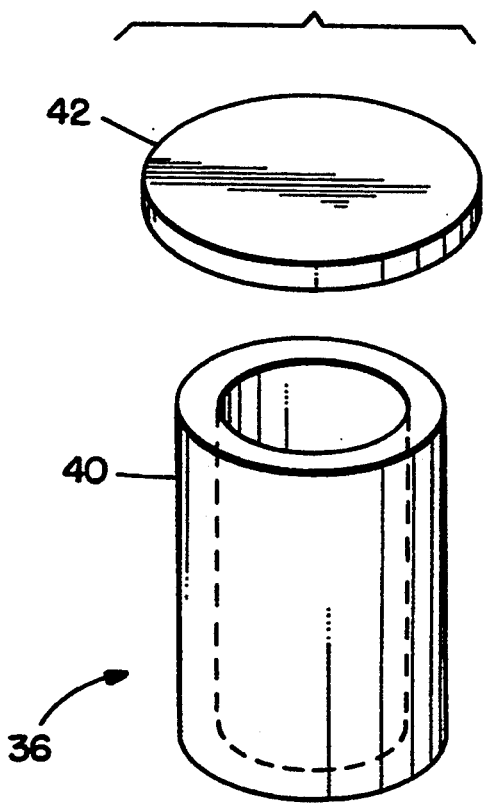
FIG. 4 is a perspective view of one embodiment of a protective container for a green body constructed in accordance with the present invention.
Figure 5:
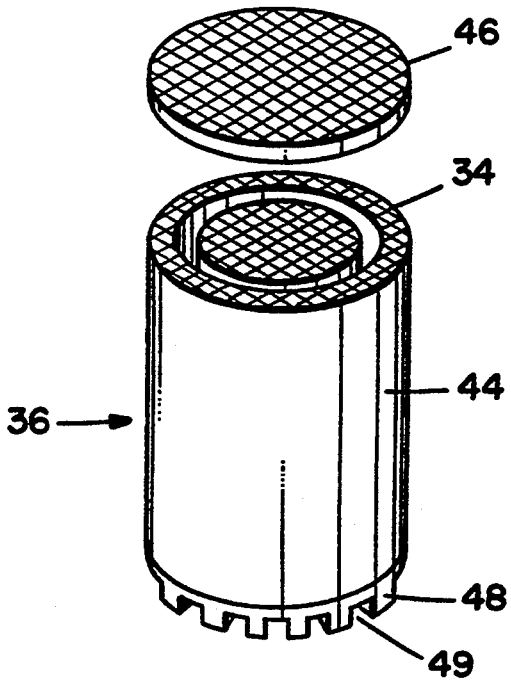
FIG. 5 is a perspective view of another embodiment of the protective container of the present invention.

Containers 36 can be constructed in various ways. Two preferred embodiments are shown in FIGS. 4 and 5. In FIG. 4, the container includes vertically extending wall 40 and loose fitting top cover 42. The walls and the cover can be made of a refractory metal, e.g., molybdenum foil (0.002–0.005 inches thick), or from an extruded metal powder which has been sintered, e.g., from the material making up the green body after firing.

In FIG. 5, the container includes vertically extending wall 44, top cover 46, and bottom cover 48, each of which is formed of an extruded metal powder which has been dried, but not fired. The extruded metal powder has a composition which is either identical to that of the green body or compatible with the green body in terms of firing, i.e., the extruded metal powder should shrink at a rate comparable to that of the green body and should not produce burn-out products which will adversely affect the firing of the green body. Preferably, wall 44 and covers 46 and 48 have a honeycomb structure, e.g., a structure of the type used in automotive catalyst supports.

Wall 44 can be conveniently formed by extruding a large greenware honeycomb substrate and then hollowing out the inside of the substrate so that it can receive the green body which is to be fired. Top cover 46 and bottom cover 48 can be ½ inch thick "cookies" of the substrate material. Use of the same material for the wall and the covers means that all parts will shrink at a uniform rate during firing. This results in less distortion as a result of drag between incompatible parts.

The bottom surface of bottom cover 48 preferably includes sawcuts 49 to allow for better gas flow through the bottom of the container, as well as to reduce drag against the hearth plate and give greater uniformity of support to the green body being fired. The sawcuts can be arranged in a checkerboard pattern, and can be cut at ¼ inch intervals to a depth of a ¼ inch.

In use, bottom cover 48 is placed on the hearth plate with sawcuts 49 facing downward. Wall 44 is then placed on the bottom cover, and the green body which is to be fired is placed inside the cavity formed by the wall. Next, a small cookie can optionally be placed on top of the green body. Finally, top cover 46 is put in place to complete the container.

The use of a greenware/honeycomb container has a number of advantages. First, all gas which reacts with the green body must first pass through the porous walls of the container. Because the container is made of greenware, it serves as a getter for gas impurities. Moreover, because the container completely encloses the green body, this getter function applies to all parts of the green body.

In addition to its getter function, the greenware also shrinks at the same rate as the green body during firing. As a result, a uniform free space is maintained between the green body and the wall of the container as both components shrink in parallel. This uniform free space further minimizes the amount of furnace gas which comes into contact with the green body during sintering.

Without intending to limit it in any manner, the present invention will be more fully described by the following examples.

EXAMPLE 1

A metal powder containing 77% iron and 23% aluminum was blended with 6% by weight of an organic binder (METHOCEL, Dow Corning) and 1% by weight of oleic acid in water. The resulting mixture was compacted, extruded through a honeycomb die, cut into one inch lengths, and then dried.

The resulting green bodies were fired in a cold-wall vacuum/atmosphere furnace manufactured by Vacuum Industries (Somerville, Mass.). Firings were performed in a hydrogen atmosphere (99.999% purity) at temperatures of 1000° C. and 1050° C. Some samples were placed in individual containers of the type shown in FIG. 4. Others were simply placed on cookies on the furnace's hearth plate.

Figure 6:
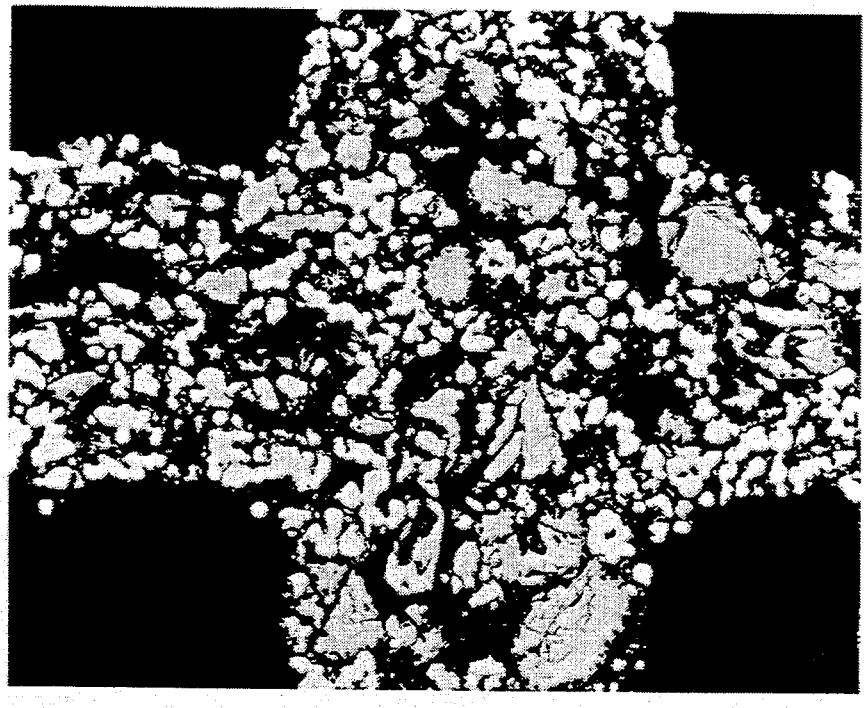
FIGS. 6 and 7 are photomicrographs showing the microstructure of samples fired with (FIG. 6) and without (FIG. 7) a protective container of the type shown in FIG. 4.
Figure 7:
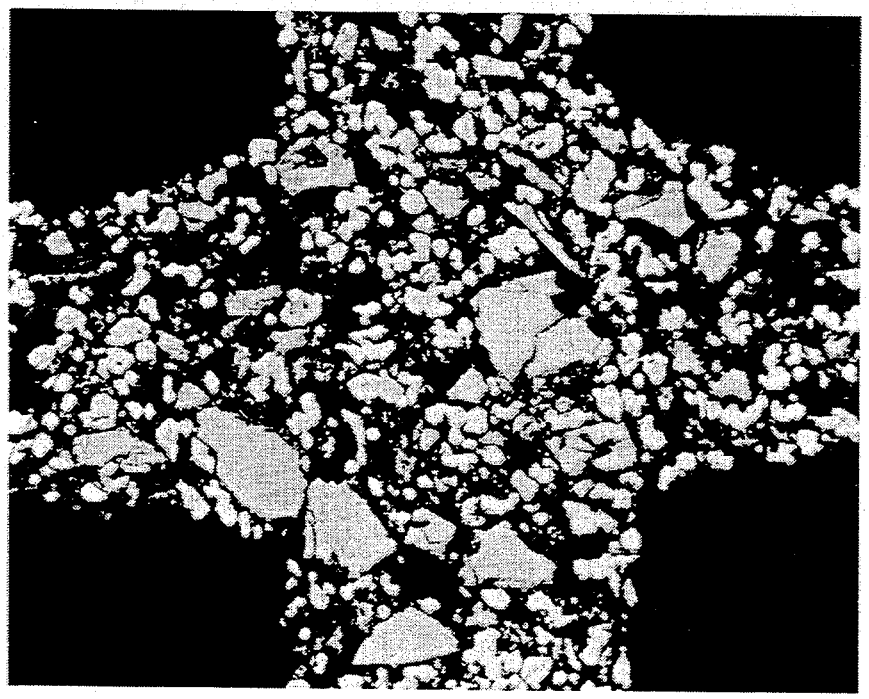

Polished sections from the samples were prepared and photographed. FIGS. 6 and 7 are representative examples of the results obtained. Specifically, FIG. 6 shows the microstructure of a sample fired at 1000° C. using a protective container, while FIG. 7 shows the results for a sample having the same composition and fired for the same period of time and under the same conditions, except for the use of the container.

A comparison of these figures shows that the sintering process progressed further in the sample fired inside the protective container. This difference can be seen by comparing the large Fe—Al alloy grains in each photomicrograph. In FIG. 7, there are many fractured angular grains indicative of incomplete sintering. In comparison, in FIG. 6, convoluted or serrated grain boundaries appear on most of the Fe—Al alloy grains. The development of convoluted or serrated grain boundaries is linked to the outward diffusion of Al from the Fe—Al grains to nearby regions of Fe grains. Al diffusion leads to compositional homogenization which is a necessary step in the sintering of this material. Retardation of sintering, as occurred without a protective canister, leaves the sample susceptible to degradation during firing by exposure to contaminants present in the furnace.

EXAMPLE 2

Metal honeycombs equivalent to those of Example 1 were fired in the same furnace and atmosphere as Example 1. In this case, the firing was to a maximum temperature of 1325° C. with a 4-hour hold at that temperature. The metal honeycomb samples were placed in the furnace for firing in protective canisters. The canisters were of different sizes and dimensions and the amount of metal honeycomb sample placed in each was varied. Table 2 describes the sample/canister arrangements.

The canister sizes and amounts of metal honeycomb sample placed in each were chosen to evaluate the effects of: 1) canister perimeter:volume ratio, 2) canister volume:sample volume ratio, and 3) canister perimeter:sample volume ratio.

After sintering, samples were tested for oxidation resistance. Standard procedures for this test were followed in which samples were carefully weighed, placed in ceramic crucibles, and then placed into an electrically heated furnace in air at a test temperature of 1100° C. After a period of time, the samples were removed from the furnace, allowed to cool, and then carefully weighed.

The samples gained weight with time due to oxidation. The weight gain was calculated and recorded as a percentage weight gain. The process of weighing, holding at 1100° C. in air, cooling, weighing, and calculating percentage weight gain was performed four times over a total period of 10 hours.

In order to conserve sample material and furnace space, canisters were constructed that had less than optimum perimeter:volume and sample mass:canister volume ratios. As a result, the sintering of the samples in this example was not optimized and optimal oxidation resistance was not achieved. Nonetheless, the measured oxidation resistance as a function of canister geometry and sample size illustrates the beneficial effects of reducing canister perimeter:volume ratio and increasing sample mass:canister volume ratio. Table 3 sets forth the measured data and Table 4 compares the results obtained for the various samples.

As shown in Table 4, the canister perimeter:canister volume ratio has an important impact on the oxidation resistance of the samples fired within the canisters. A lower perimeter:volume ratio results in samples with better oxidation resistance which reflects more complete sintering. A greater sample volume:canister volume ratio also results in better oxidation resistance and indicates better sintering.

In addition to the foregoing samples, two additional samples, i.e., samples "X" and "Y", were tested. Sample X had a much lower canister perimeter:volume ratio and a higher sample volume:canister volume ratio than any of samples 1–5. As a result, the oxidation resistance of sample X was far better than that of samples 1–5. Sample Y was fired under similar conditions to samples 1–5 but without any protective canister. The oxidation resistance of this sample was much inferior to any sample fired within a protective canister.

A variety of modifications which do not depart from the scope and spirit of the invention will be evident to persons of ordinary skill in the art from the disclosure herein. The following claims are intended to cover the specific embodiments set forth herein as well as such modifications, variations, and equivalents.

TABLE 1

Perimeter/Volume Ratios With Changes in Diameter and Height For a Constant Cylindrical Volume

| Diameter (in.) | Height (in.) | Perimeter (in.) | Volume (in.$^3$) | Perim./vol. (1/in.$^2$) |
|---|---|---|---|---|
| 5 | 1.080 | 19.63 | 21.21 | 0.93 |
| 4 | 1.688 | 12.57 | 21.21 | 0.59 |
| 3 | 3.000 | 7.07 | 21.21 | 0.33 |
| 2 | 6.751 | 3.14 | 21.21 | 0.15 |
| 1 | 27.000 | 0.79 | 21.21 | 0.04 |

TABLE 2

| Sample | can diam. (cm) | can ht. (cm) | can vol. (cm$^3$) | can perim. (cm) | sample vol. (cm$^3$) | sample wt. (g) |
|---|---|---|---|---|---|---|
| 1 | 5.08 | 2.54 | 51.5 | 16.0 | 20.5 | 26.22 |
| 2 | 2.54 | 10.16 | 51.5 | 8.0 | 20.5 | 26.17 |
| 3 | 2.54 | 10.16 | 51.5 | 8.0 | 10.5 | 13.51 |
| 4 | 5.08 | 7.62 | 154.4 | 16.0 | 60.6 | 77.70 |
| 5 | 7.62 | 3.38 | 154.1 | 23.9 | 60.2 | 77.22 |
| X* | | | 1750 | 175 | 975 | 1300 |

*rectangular canister, 10 cm × 10 cm × 17.5 cm

TABLE 3

ACCELERATED OXIDATION AT 1100° C. IN AIR (Weight gain in percent)

| Sample | hours: 1 | 4.4 | 7 | 10 |
|---|---|---|---|---|
| 1 | 1.39 | 2.60 | 3.26 | 3.92 |
| 2 | 1.18 | 2.11 | 2.86 | 3.27 |
| 3 | 1.36 | 2.36 | 3.32 | 3.71 |
| 4 | 1.26 | 2.30 | 2.91 | 3.43 |
| 5 | 1.36 | 2.60 | 2.79 | 3.77 |
| X | 0.54 | 1.08 | 1.31 | 1.52 |
| Y* | 2.70 | 6.89 | 12.89 | 15.03 |

*no protection.

TABLE 4

| Samples Compared | Attribute Compared | Attributes Held Constant | Predicted Results | | Measured Results* (% difference) | |
|---|---|---|---|---|---|---|
| 1:2 | can perimeter: P1 = 2(P2) | sample/can volume | 2<1 | 2<1 | 3.27<3.92 | (~20%) |
| 4:5 | can perimeter: P5 = 1.5(P4) | sample/can volume | 4<5 | 4<5 | 3.43<3.77 | (~10%) |
| 2:3 | sample volume: V2 = 2(V3) | can perimeter/volume | 2<3 | 2<3 | 3.27<3.71 | (~13%) |
| 1:3 | ratio of can perimeter to sample volume: P1:V1 = 1.03(P3:V3) | can perimeter/volume | 1≧3 | 1>3 | 3.92>3.71 | (~6%) |

*10 hour data from Table 3

What is claimed is:

1. A furnace for firing a green body composed of an extruded metal powder comprising:
   (a) heating means;
   (b) non-gas tight insulating means, said heating means and said insulating means defining a hot zone and a cold zone within said furnace;
   (c) a non-gas tight chamber within the hot zone for receiving the green body;
   (d) first introducing means for introducing one or more gases into the chamber;
   (e) second introducing means for introducing one or more gases into the cold zone; and
   (f) gas exit means for removing gases from the hot zone;
   whereby the flow of gases within the furnace is from the chamber and the cold zone into the hot zone and out of the hot zone through the gas exit means.

2. The furnace of claim 1 wherein the first and second introducing means further comprise flow controllers.

3. The furnace of claim 2 wherein the flow controllers are adjusted to create pressures P1, P2 and P3 in the cold zone, the hot zone and non-gas tight chamber respectively.

4. The furnace of claim 3 wherein P1 and P2 are individually greater than P3.

5. The furnace of claim 4 wherein P1 is approximately equal to P2.

6. The furnace of claim 1, wherein the gas exit means is connected directly to the hot zone.

7. The furnace of claim 1, wherein the gas exit means is connected directly to the cold zone.

* * * * *